United States Patent [19]

Ohba

[11] 4,404,436

[45] Sep. 13, 1983

[54] PUSH-PUSH MECHANISM OF PUSHBUTTON OPERATING SHAFT

[75] Inventor: Hiroki Ohba, Furukawa, Japan

[73] Assignee: Alps Electric Co., Ltd., Tokyo, Japan

[21] Appl. No.: 323,034

[22] Filed: Nov. 19, 1981

[30] Foreign Application Priority Data

Nov. 19, 1980 [JP] Japan ..... 55-166012[U]

[51] Int. Cl.[3] ..... H01H 3/12

[52] U.S. Cl. ..... 200/153 J; 200/328

[58] Field of Search ..... 200/153 J, 328

[56] References Cited

U.S. PATENT DOCUMENTS 3,914,750 10/1975 Lockard .

4,254,315 3/1981 Stevens ..... 200/153 J

FOREIGN PATENT DOCUMENTS 1179282 10/1964 Fed. Rep. of Germany ... 200/153 J

*Primary Examiner*—John W. Shepperd

*Assistant Examiner*—Renee S. Kidorf

*Attorney, Agent, or Firm*—Guy W. Shoup; Gerard F. Dunne

[57] ABSTRACT

A push-push mechanism of a pushbutton operating shaft characterized in that a driving member of a tubular body is rotatably supported upon the operating shaft of the push button. The driving member is provided with a protuberance extending orthogonally to the direction of movement of the operating shaft, and a cam plate formed with a heart-shaped groove in its upper surface is received in a frame so that the cam plate can move upwardly by being guided by the inner wall of the frame.

3 Claims, 3 Drawing Figures

PUSH-PUSH MECHANISM OF PUSHBUTTON OPERATING SHAFT

BACKGROUND OF THE INVENTION

The present invention relates to the push-push mechanism of a pushbutton operating shaft which may be included in a switch, a volume control or the like used in a radio set or any other audio equipment. More particularly, it relates to the push-push mechanism of a pushbutton operating shaft which can perform a reliable operation with a simple construction.

In recent years, the use of automobiles has increased remarkably, and the use of car radios has similarly increased. A car radio is typically installed in a place comparatively near the body of the driver so that tuning and adjustments of sound volume and the like can be made easily during driving. Unfortunately, however, a part of the body can inadvertently touch one of the controls of the radio, such as the operating shaft for the volume control during driving of the car. Thus, the control may be actuated unintentionally to, for example, turn the operating shaft of the volume control to increase the sound volume unexpectedly or, conversely, establish an inaudible sound level. Such an unexpected happening can, of course, lead to a serious traffic accident, especially if in occurs in traffic. As a safety measure, accordingly, a so-called push-push mechanism for a pushbutton operating shaft has been proposed and put into practical use. In, for example, the aforecited volume control for the sound volume adjustment, the operating shaft is pressed inwardly of the car radio upon completion of adjustment so as not to project considerably from the surface of a panel, and it extends outwardly form the car radio only when operation is necessary.

FIG. 1 is a view for explaining a prior-art push-push mechanism for a pushbutton operating shaft of the type specified above. A frame 102 which receives the push-push mechanism is coupled to the rear of the body 101 which contains the volume control mechanism, and an operating shaft 103 which extends through the body 101 is slidably protruded into the frame 102. The rear end part of the operating shaft 103 is provided with an engaging groove 103*a*, which holds an engaging portion 104*c* of a slider 104. The slider 104 may be slid by depressing the operating shaft 103, and it is formed with a heart-shaped cam groove 104*a* in its upper surface and a recess 104*b* in its lower surface. A leaf spring 105 is interposed between the top of the frame 102 and the cam groove 104*a*, and one end of a generally Z-shaped driving pin 106 is urged by the leaf spring 105 into resilient engagement with the cam groove 104*a*. A resetting coiled spring 107 urges the slider 104 in the direction reverse to the depressing direction of the operating shaft 103 and is retained between the recess 104*b* and the rear side plate of the frame 102. The other end of the driving pin 106 is pivotally supported in a hole 105*a* which is provided in the leaf spring 105.

Accordingly, upon depressing the pushbutton operating shaft 103, the slider 104 is moved by this depressing operation, and one end of the driving pin 106 is moved along the heart-shaped cam groove 104*a*. Upon releasing the depressing force, the depressed state of the operating shaft 103 of the pushbutton is locked by the cooperation between the driving pin 106 and the cam groove 104*a*, as well known in the art. Upon depressing the operating shaft 103 again, the locked state is released and the operating shaft 103 is urged outwardly by the spring 107. Numeral 108 indicates a cover which overlays the open surface of the frame 102 and which is fixed by protuberant pieces 102*a* of the frame 102.

In prior art push-push mechanisms as described above, one end of the driving pin 106 must move both vertically and laterally with respect to the moving direction of the operating shaft 103 and therefore some play is required. In addition, the slider 104 needs to move smoothly within the frame 102 in engagement with the engaging groove 103*a* formed at the rear end part of the operating shaft 103, and therefore some play must be provided between it and the frame 102. For this reason, it is difficult to set the stop position for the operating shaft 103, as determined by the heart-shaped cam groove 104*a* and the driving pin 106, at a high dimensional accuracy, and inevitably safety must be allowed for in design, which has led to the disadvantage that the switch, the sound volume or the like becomes large in size. Moreover, since the driving pin 106 is easy to move, there has been the disadvantage that upon action of vibrations, an impact or the like, the front end of the driving pin 106 rises, so the operation cannot be carried out smoothly and reliably.

SUMMARY OF THE INVENTION

Accordingly, the present invention has for its object to provide a push-push mechanism of a pushbutton operating shaft which can execute a smooth and reliable push-push operation without play, which affords a good feel for is switching operation, in which any engagement does not come off due to vibrations or an impact, and the assembling job of which is simple.

In order to accomplish the object, a mechanism of a pushbutton operating shaft according to the present invention comprises a tubular driving member supported rotatably upon the operating shaft of the push button and has a protuberance extending orthogonally to the direction of movement of said operating shaft. A cam plate whose upper surface is formed with a heart-shaped cam groove is received within a frame member so that the latter can move by being guided by an inner wall of the former. The depressed state of the operating shaft is held by the cooperation between said protuberance and said groove by holding an end of said protuberance in engagement with said cam groove.

BRIEF DESCRIPTION OF THE DRAWINGS

FIG. 1 is a sectional view of the prior-art push-push mechanism of a pushbutton operating shaft, and FIGS. 2 and 3 serve to explain a push-push mechanism of a pushbutton operating shaft according to the present invention, in which

PREFERRED EMBODIMENT OF THE INVENTION

Hereunder, an embodiment of the present invention will be described in detail with reference to the drawings.

Figure 1:
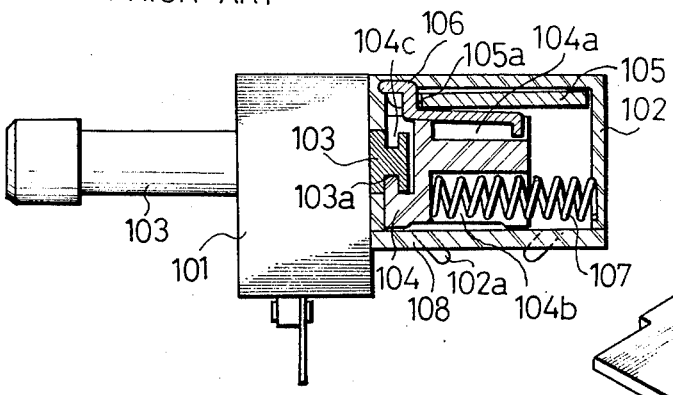
Fig.1 PRIOR ART
Figure 2:
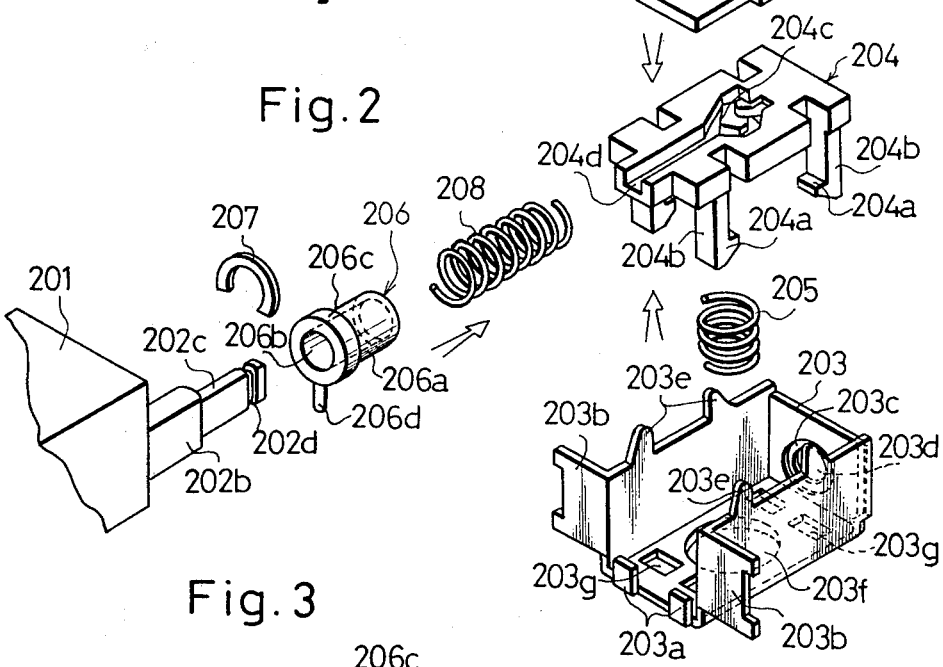
FIG. 2 is an exploded perspective view of the push-push mechanism and FIG. 3 is a section view thereof.
Figure 3:
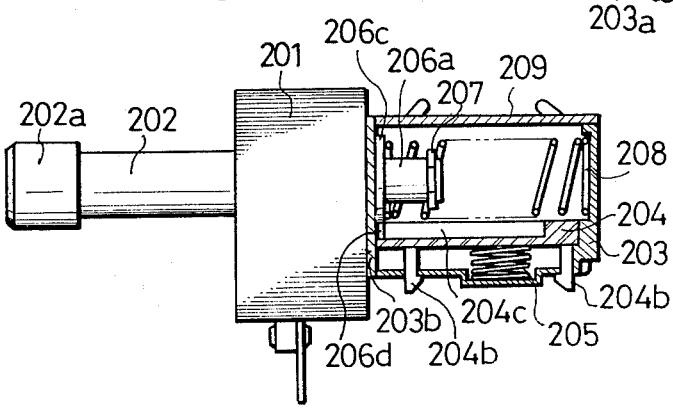

FIGS. 2 and 3 are explanatory views of a push-push mechanism of a pushbutton operating shaft according to the present invention, in which FIG. 2 is an exploded perspective view of the push-push mechanism and FIG. 3 is a sectional view of the essential portions thereof.

Numeral 201 designates the housing for a volume control mechanism, in which a stator with a resistor formed on an insulating base plate by such an expedient as printing and a rotor supporting a slide piece made of a conductor and adapted to slide on the resistor in opposition to the stator are disposed, though not shown since these structures are well understood in the art. The rotor is fixed to an operating shaft 202 slidable axially and which extends completely through the volume control mechanism. The rotor is held to the operating shaft 202 in such a manner that it can be rotated unitarily with the operating shaft 202.

The operating shaft 202 includes a knob portion 202*a*, an intermediate portion 202*b* of smaller diameter, and an end portion 202*c* which is formed at the rear end of the intermediate portion 202*b* and is of a still smaller diameter and has a groove 202*d* formed in its rear end part. Each of the intermediate portion 202*b* and the end portion 202*c* has its sides flattened to form a generally oval-shaped section. The rotor of the volume control is adapted to fit over the oval-shaped intermediate portion 202*b* and thus the rotor will be rotated by turning the operating shaft 202 and yet the operating shaft can be slid axially through the rotor.

Numeral 203 indicates a box-shaped frame which is coupled to the rear part of the housing 201, and which receives a mechanism engaging the end portion 202*c* of the operating shaft 202 for holding the operating shaft 202 in its inner axial position. The side walls of the frame 203 in the longitudinal direction thereof are bent outwardly at right angles in the fashion of a double-leafed hinged door to form two bent pieces 203*b* forming mounting pieces, and portions of the bottom wall are bent upwardly to form bent pieces 203*a*, as shown in FIG. 2.

The rear wall is centrally provided with a hole 203*d* and is also formed with a recess 203*c* formed in the inner surface of the rear wall. Each side wall parallel to the longitudinal direction is formed with two protuberant pieces 203*e* extending upwardly from its open end. Further, the inner surface of the bottom wall is formed with a recess 203*f* in substantially the central part thereof, and holes 203*g* are provided in the four corners of the bottom wall.

Numeral 204 indicates a cam plate having outside dimensions substantialy equal to those of the bottom wall of the frame 203. The lower surface of the cam plate is formed with mounting legs 204*b* which have hook-like engaging portions 204*a* at their lower ends and which engage the respective holes 203*g* provided in the bottom wall of the frame 203, while the upper surface is formed with a heart-shaped cam groove 204*c* and a straight guide groove 204*d* which extends from one end of the heart-shaped cam groove 204*c* to an end part of the cam plate in the longitudinal direction thereof. An operating pin of a driving member to be described later is guided along the guide groove 204*d*.

Numeral 205 designates a coiled spring which is placed in the recess 203*f* formed in the bottom wall of the frame 203 and which urges the cam plate 204 upwards. Numeral 206 indicates the driving member which is turnably fitted on the end portion 202*c* of the operating shaft 202, and which includes a cylindrical tubular body 206*a*, a hole 206*b* for receiving the end portion 202*c* of the operating shaft 202 therethrough, a flange portion 206*c* provided at one end of the tubular body 206*a*, and the operating pin 206*d*, provided in a manner to protrude orthogonally from the flange portion. Numeral 207 indicates a C-shaped washer for holding the driving member 206 to the end part of the operating shaft 202. Numeral 208 represents a coiled spring which urges the operating shaft 202 in the reverse direction to the depressing direction thereof by its abutment against the flange portion 206*c* of the driving member 206, and which is retained between the flange portion 206*c* and the recess 203*c* formed in the rear wall of the frame 203. Numeral 209 represents a cove which overlays the top opening of the frame 203.

Now, there will be explained the assemablage of the mechanism of the pushbutton operating shaft according to the present invention.

First, the driving member 206 is fitted onto the end portion 202*c* of the operating shaft 202 with its flange portion 206*c* facing towards the housing 201, and the washer 207 is mounted in the groove 202*d*. Thus, the driving member 206 moves in the depressing direction of the operating shaft 202 unitarily with this operating shaft and is also rotatable around the end portion 202*c*.

Subsequently, the coiled spring 205 is installed in the recess 203*f* in the bottom wall of the frame 203, the cam plate 204 is inserted so as to lie thereon with the heart-shaped groove 204*c* facing upwardly, and the mounting legs 204*b* formed at the lower surface of the cam plate are respectively inserted into the corresponding holes 203*g* of the frame 203. Thus, the cam plate 204 is held by the coiled spring 205 and in a manner so as to be vertically movable with the frame 203 as it is guided by the inner walls of the frame 203. In this case, the cam plate 204 has its lengthwise and widthwise movements limited by the side and end walls and the bent pieces 203*a*.

At the next step, the cover 209 is placed over the open surface of the frame 203, and the protuberant pieces 203*e* provided at the open end are bent to fix the cover. Thereafter, the coiled spring 208 is fitted on the tubular body 206*a* of the driving member 206 attached to the end portion 202*c* of the operating shaft 202. Subsequently, whilst holding one end of the coiled spring 208 in abutment against the recess 203*c* provided in the rear wall of the frame 203 in the longitudinal direction, the driving member 206 is inserted into the frame 203. At this time, the lower end of the operating pin 206*d* of the driving member 206 is brought into engagement with the guide groove 204*d* of the cam plate 204, and the driving member 206 is inserted into the frame 203 so that the operating pin 206*d* may move along the cam groove 204*d*.

Lastly, the mounting pieces 203*b* of the frame 203 are brought into close contact with the rear part of the housing 201, whereupon the mounting pieces 203*b* are fastened to the housing. The assemblage of the mechanism of the pushbutton operating shaft according to the present invention is thus completed and illustrated in FIG. 3. In this way, the state is established in which the operating pin 206*d* is normally held in pressed contact with the bottom surface of the heart shaped cam groove 204*c* by the coiled spring 205 and in which the operating shaft 202 is urged in the reverse direction to the depressing direction thereof by the coiled spring 208.

When the operating shaft 202 is pressed in against the spring pressure of the coiled spring 208, the operating pin 206*d* of the driving member 206 moves along the guide groove 204*d*. When the depression of the operating shaft 202 is continued, the operating pin 206*d* begins its engagement with the heart-shaped groove 204*c*. When the operating shaft is further depressed, the operating pin 206*d* moves along the heart-shaped cam groove 204*c* while turning in accordance with the amount of depression. When the depression is released at the end position of the path of the heart-shaped groove 204*c*, the operating pin 206*d* is brought to and engaged with an intermediate position of the heart-shaped cam groove 204*c* by the spring force of the coiled spring 208, and the depressed operating shaft is locked. Subsequently, when the operating shaft 202 is depressed again, the operating pin 206*d* moves away from the intermediate position of the heart-shaped cam groove 204*c* and enters the returning path thereof. When the depression is thereafter released, the operating pin 206*d* is reset to its original position by the spring pressure of the coiled spring 208.

As described above, according to the present invention, the operating pin 206*d* is disposed in a manner so as to protrude from the tubular body installed on the end portion of the operating shaft, so that it is rotatable in only the rotary direction of the operating shaft and can perform a reliable operation without becoming loose as in the prior art. In addition, owing to the construction in which the cam plate 204 is received in the frame and is guided for movement within the frame, it can move only in the vertical direction, so that a very accurate push-push operation can be executed with the operation of the operating pin. Further, since the central part of the cam plate 204 is urged by the coiled spring 205, the cam plate smoothly moves vertically and the feel of operation of the mechanism is good. Besides, since the driving member 206 has the flange portion 206*c* depressed by the coiled spring 208, it maintains its position despite vibration or an impact as in the prior art. Moreover, since the frame 203 in which the cam plate 204 is assembled together with the coiled spring 205 in advance may be merely mounted on the housing 201, the assembling operations are simple.

I claim:

1. A mechanism for holding a pushbutton operating shaft in a latched condition and later enabling the shaft to be released from its latched condition, comprising a tubular driving member supported rotatably upon the operating shaft and provided with a protuberance extending orthogonally to the direction of axial movement of said operating shaft, means including a cam plate having an upper surface formed with a heart-shaped groove adapted to receive said protuberance for holding the operation shaft in its latched position and later enabling it to be released therefrom, a frame member receiving said cam plate therein so that the latter can move vertically while being guided by an inner wall of the former, and means urging said cam plate upwardly within said frame member, said operating shaft being latched in a depressed state by the cooperation between said protuberance and said heart-shaped groove by holding an end of said protuberance in engagement with said heart-shaped cam groove.

2. A mechanism of a pushbutton operating shaft as defined in claim 1, wherein said tubular driving member is formed with a flange portion, and a coiled spring is arranged between said flange portion and said frame member.

3. A mechanism of a pushbutton operating shaft as defined in claim 1, wherein said urging means includes a coiled spring arranged between a recess formed in a bottom of said frame member and the underside of said cam plate formed with said heart-shaped groove.

* * * * *